United States Patent [19]

Cory

[11] 4,111,115

[45] Sep. 5, 1978

[54] CONTINUOUS FILTER PRESS

[75] Inventor: Charles E. Cory, Sebastopol, Calif.

[73] Assignee: Bepex Corporation, Santa Rosa, Calif.

[21] Appl. No.: 799,453

[22] Filed: May 23, 1977

[51] Int. Cl.[2] ..... B30B 9/06; B30B 3/04

[52] U.S. Cl. ..... 100/116; 100/158 C

[58] Field of Search ..... 100/116, 121, 158 R, 100/158 C

[56] References Cited

U.S. PATENT DOCUMENTS

| | | | |
|---|---|---|---|
| 2,146,158 | 2/1939 | Scherer | 100/158 C |
| 3,053,171 | 9/1962 | Asplund | 100/158 C |
| 3,086,453 | 4/1963 | Asplund | 100/158 C X |
| 3,105,434 | 10/1963 | Messing | 100/158 C |
| 3,447,450 | 6/1969 | Wilhelm | 100/158 C X |
| 3,948,165 | 4/1976 | Seifert | 100/116 |

FOREIGN PATENT DOCUMENTS

| | | | |
|---|---|---|---|
| 897,024 | 5/1962 | United Kingdom | 100/116 |

*Primary Examiner*—Edward J. McCarthy
*Attorney, Agent, or Firm*—Flehr, Hohbach, Test, Albritton & Herbert

[57] ABSTRACT

A continuous filter press of the type having wheels provided with conical screens and carried by pivoted side structures, the arrangement being such that material (e.g., a slurry) fed into the space between the wheels is carried through a pinch zone and then discharged. The claimed improvements to such presses include special means for journalling the wheels which employs a sleeve instead of a stud shaft, and material diverting means or plow which has portions on its inner end that are accommodated in central openings of the wheels.

7 Claims, 8 Drawing Figures

CONTINUOUS FILTER PRESS

BACKGROUND OF THE INVENTION

This invention relates generally to filter presses of the continuous type such as are employed for extracting water or other liquids from various fluid or semi-fluid feed materials. The invention is particularly applicable to extracting water from various pulps, slurries, or other semi-solid materials, including, for example, paper pulps, sewage sludges, vegetable and fruit pulps, tomato and grape pomace, citrus peel, fish or fish processing slurries, cannery wastes and brewers and distillers grains.

U.S. Pat. No. 3,447,450, dated June 3, 1969, discloses a continuous filter press of the type making use of wheels provided with conical shaped screens on their inner faces and carried by side structures in such a manner that the intersecting axes of the wheels during operation are out of alignment. When the wheels are rotated, portions of the screens are brought into proximity in a pinch zone, and other portions of the screens are separated to form a feed receiving space. Feed material (e.g., a slurry) introduced into the feed receiving space is carried through the pinch zone to express liquid from the same, and the material leaving the pinch zone is diverted through a discharge opening in the surrounding casing. A plow serves to divert the material through the discharge opening, and as shown in U.S. Pat. No. 3,447,450, the outer end of the plow is secured to the casing and the inner wedge-shaped end is disposed between the central portions of the wheels. Thus the plow is supported cantilever fashion by the attachment of its outer end to the casing. The journalling of the wheels as disclosed in U.S. Pat. No. 3,447,450 makes use of stud shafts secured to the wheels and journalled on the adjacent side structures. Also thrust bearing means is interposed between the inner faces of the side structures and the adjacent faces of the wheels in regions near the outer peripheral margins of the wheels. The lateral dimensions of the inner end of the plow must be relatively close together in the pinch zone. With the construction shown in said patent, it is difficult to design and construct a plow having sufficient strength to withstand the forces to which it is subjected, particularly when the press is constructed in the larger sizes or when it is desired to have the screens very close together in the pinch zone to facilitate the handling of slippery feed materials. Also the journalling of the wheels by use of simple stud shafts has some disadvantages which again are more apparent for machines made in the larger sizes. Stud shafts do not permit access to the space between the wheels through the side structures and the wheels, and therefore all clean-up operations must be carried out by swinging the side structures apart to open the space between the wheels.

OBJECTS AND SUMMARY OF THE INVENTION

In general, it is an object of the present invention to improve upon the continuous filter press disclosed and claimed in Wilhelm U.S. Pat. No. 3,447,450.

Another object is to provide a continuous filter press construction which has a plow of adequate strength which does not interfere with positioning of the screens of the wheels relatively close together in the pinch zone.

Another object is to provide improved means for mounting and journalling the wheels upon the cooperating side structures, with the wheels and journalling means so constructed that access can be had through the wheels for cleaning purposes.

In general, the present invention consists of a machine frame having a pair of rigid side structures pivotally secured to the same whereby the structures can be moved toward or away from each other. A pair of opposed wheels are journalled to the side structures on intersecting axes. Each wheel includes a conical shaped screen covering the inner face of an annular wheel structure. Means is provided for yieldably urging the side structures and the wheels toward each other. The axes of the wheels during operation are out of alignment whereby when the wheels are rotated portions of the screens are brought into proximity in a pinch zone, and other portions of the screens are separated to form a feed receiving space. A casing is carried by the frame and surrounds the space between the wheels. The casing is provided with an inlet opening for receiving feed material, and a discharge opening for receiving material that has been carried through the pinch zone. A rigid plow is disposed between the wheels, one end of the plow being secured to the casing in a region between the inlet and discharge openings, and the other end of the plow is disposed between the wheels in the central region of the casing. During operation of the press the plow serves to divert material leaving the pinch zone through the discharge opening. The means employed for journalling each wheel to its corresponding side structure preferably consists of an annular sleeve fixed to the wheel structure and extending from the outer side of the wheel concentric with the axis of the same. The corresponding side structure has an opening to accommodate the sleeve, and means is carried by the side structure for journalling the sleeve. Each wheel structure and its associated screen has a central opening and the inner end of the plow is constructed to provide projecting rings on its opposite sides, the rings being dimensioned to be accommodated within the opening of its corresponding wheel.

Additional objects and features of the invention will appear from the following description in which the preferred embodiment has been set forth in detail in conjunction with the accompanying drawing.

DESCRIPTION OF THE PREFERRED EMBODIMENT

Figure 2:
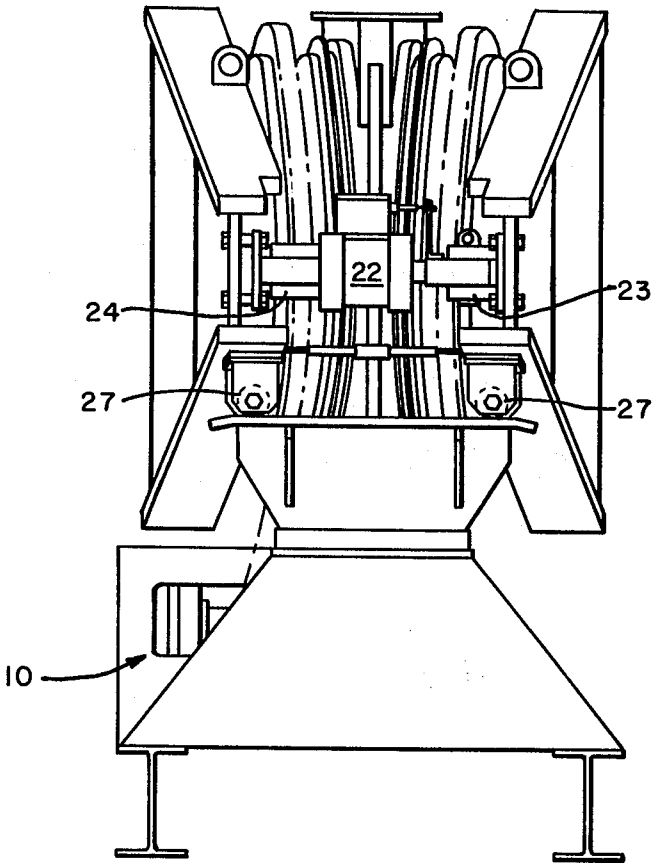
FIG. 2 is a front elevational view of the machine shown in FIG. 1, looking toward the left hand end of that figure.
Figure 1:
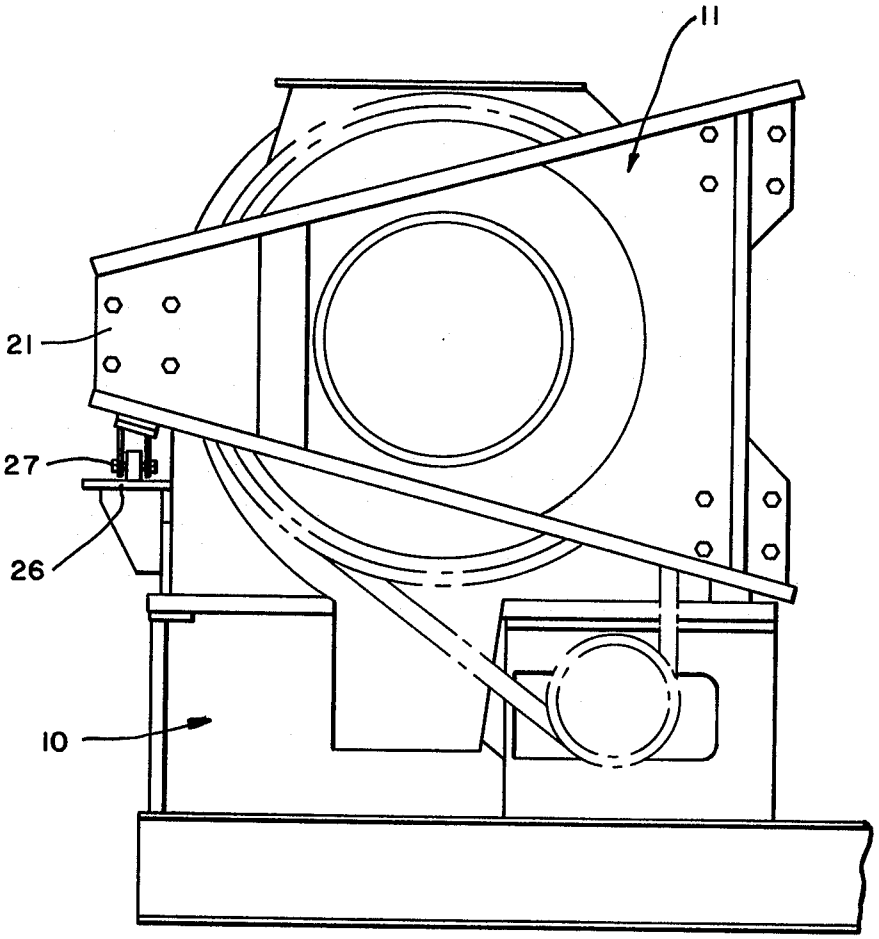
FIG. 1 is a side elevational view illustrating a continuous filter press made according to the present invention.
Figure 3:
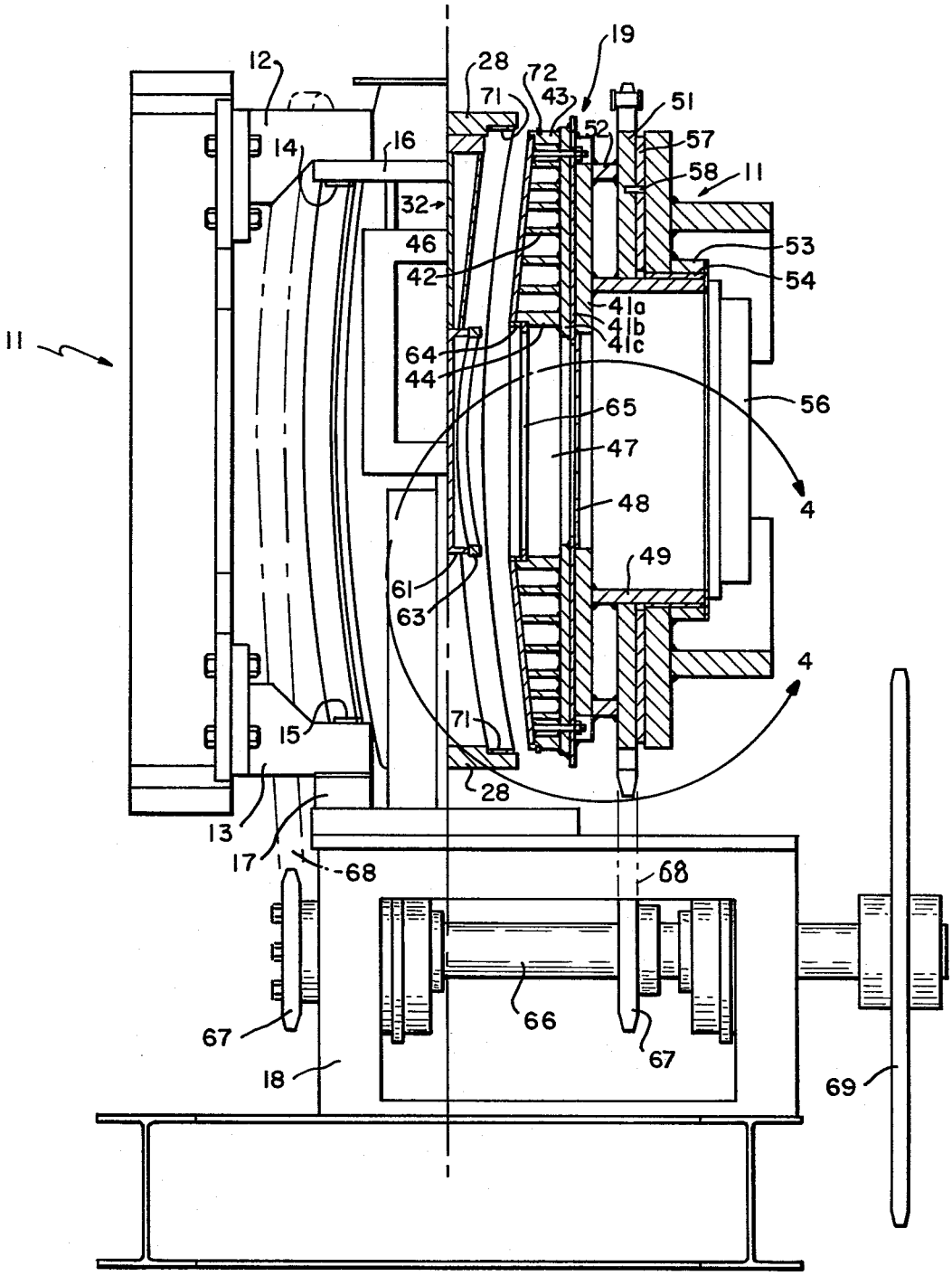
FIG. 3 is a view looking toward the right hand end of FIG. 1 and in half section with respect to the side structure, one of the wheels and the associated casing and plow.

Referring to FIGS. 1 – 3, the filter press consists of a base or frame 10 which serves to carry the working parts of the machine. The rigid side structures 11, which may be fabricated, are pivotally carried by the frame whereby they can be moved toward or away from each other. Thus as shown in FIG. 3, one end of each side structure 11 is provided with brackets 12 and 13 that are pivoted by pins 14 and 15 to members 16 and 17. Member 16 is carried by the casing of the machine, to be presently described, and member 17 is carried by the structure 18 which forms a part of the machine frame. The side structures 11 serve to rotatably carry the wheels 19 which will be presently described in detail.

Pivotal movement of the side structures preferably is on a vertical axis, and the free end portions 21 (FIG. 1) of the side structures are preferably connected by means which yieldably urges the side structures together. The device 22 provided for this purpose is shown in FIG. 2 and is of the cylinder-piston type. The piston is connected at 23 with the adjacent end of one of the side structures, and the cylinder portion is connected at 24 with the other side structure. The device 22 in normal operation is connected to a source of hydraulic liquid under pressure, preferably in such a manner that the pressure and the forces applied to the side structures can be controlled. Underlying the portions 21 of the side structures 11, there is plate 26 likewise carried by the frame of the machine, and which is shown engaged by rollers 27 carried by the adjacent portions 21 of the side structures.

Figure 5:
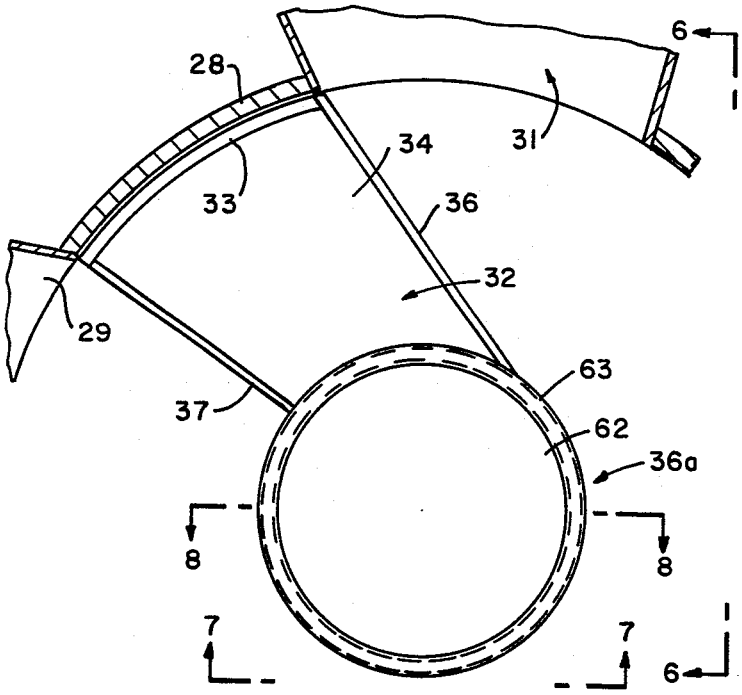
FIG. 5 is a side elevational view of the plow and showing its position relative to the casing.

The space between the wheels 19 is surrounded by casing 28 which is likewise fixed to the main frame. It has an opening 29 (FIG. 5) for introducing feed material and a discharge opening 31 through which the material is discharged after passing through the pinch zone. It is assumed in this instance that the pinch zone is on the right hand side of FIG. 5. To enable diversion of material through the discharge opening 31, there is a plow 32 which can be fabricated by welding from metal plate. In this instance its main portion is fabricated from a curved end plate 33, the side plates 34, plates 36 and 37, and the central interior plate 38, whereby when these plates are fabricated by welding a box-like structure is formed having the configuration shown in FIGS. 5 and 6. The portion 36a of the plow forms the inner end that is disposed between the central portions of the wheels. The construction of this portion will be presently described in detail.

The filter wheels 19 which are carried by the side structures 11 are preferably made as illustrated in FIG. 3.

The particular construction shown consists of annular plates 41*a* and 41*b* that are secured together as by welding. Radial ribs or bars 41*c* are secured to the face of plate 41*b* as by welding, and the annular concentric ribs 42 and also the outer and inner annular ribs 43 and 44 are mounted upon the radial ribs 41*c*. A conical shaped screen 46 extends over the ribs 42, 43 and 44 and may be bolted to the base of the wheel at circumferentially spaced points along the outer and inner margins of the screen. A central opening 47 extends entirely through the wheel and normally may be covered by the removable closure 48. A sleeve 49 is fixed as by welding to the outer face of the annular plate 41*a* and preferably has an internal diameter somewhat greater than the diameter of the opening 47.

For the purpose of driving each wheel, a sprocket 51 is provided between the wheel and the adjacent side structure. Each sprocket is shown directly secured as by welding to the annular plate 41*a* of the adjacent wheel structure by connecting part 52, and is also mounted upon the sleeve 49 and secured thereto as by welding. That part of the sleeve 49 which extends beyond the sprocket 51 is journalled by the annular portion 53 of the side structure. The journal bushing 54 may be made of suitable plastic material, such as polyethylene. The space within the sleeve 49 can be enclosed by a suitable removable cover 56 which is secured to the annular portion 53.

Thrust bearing means 57 is interposed between the flat outer face of the sprocket wheel 51 and the adjacent inner flat face of the corresponding side structure 11. Preferably the thrust bearing means consists of a relatively flat annulus made of suitable material such as polyethylene which is connected to the sprocket 51 as by pins 58.

Figure 6:
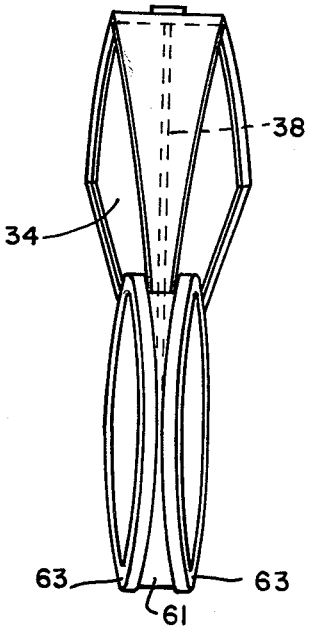
FIG. 6 is another view of the plow looking toward the right hand side of FIG. 5 as indicated by lines 6 — 6.
Figure 7:
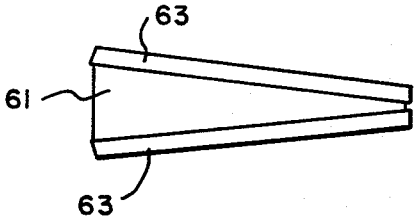
FIG. 7 is a bottom view of the inner end portion of the plow.
Figure 8:
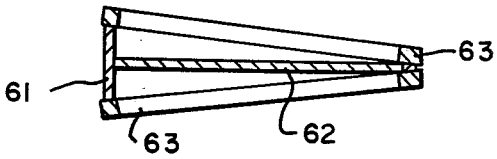
FIG. 8 is a cross-sectional view taken along the line 8 — 8 of FIG. 5.

A suitable construction for the inner end portion 36*a* of the plow 32 is shown in FIGS. 6 – 8. It consists of a ring 61 having a wedge shaped configuration as shown in FIGS. 7 and 8, secured as by welding to the central annular plate 62. One side of the ring 61 is secured as by welding to the adjacent arcuate edges of the plates 34 and 38, and also to the adjacent edges of the plates 36 and 37. Additional rings or ring extensions 63 are secured as by welding to the end edges of the ring 61. The outer diameter of each ring 63 is somewhat less than the diameter of the opening 47 through the adjacent wheel. The inner annular rib 44 of each wheel is recessed to receive a pressed in wear ring 64, which has a flange 65 at its outer end.

Figure 4:
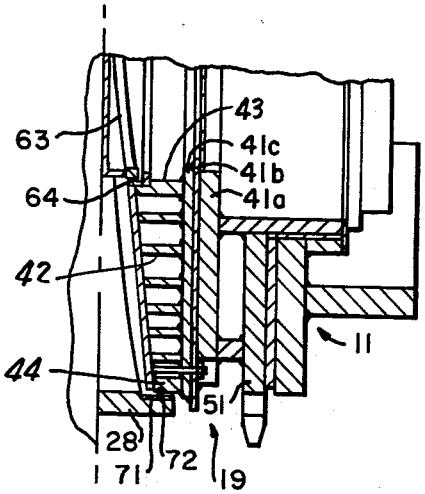
FIG. 4 is a detail in section illustrating the relationship between the wheel and the plow when the parts are positioned for normal operation.

When the machine is in normal operation, each wheel 19 is in a position with respect to the inner end of the plow substantially as shown in FIG. 4. It will be noted that the corresponding ring 63 of the plow is accommodated within the wear ring 64 whereby it does not interfere with closing of the wheels to provide a relatively narrow pinch zone. At the same time the rings 63 reinforce the plow whereby it is capable of withstanding relatively heavy forces during operation, having reference particularly to the heavy forces that are experienced in machines made in the larger sizes.

The means shown for driving the wheels is similar to that shown in U.S. Pat. No. 3,447,450. Briefly, it consists of a countershaft 66 journalled on the frame structure 18 and provided with two sprockets 67 which drive the sprockets 51 of the wheels through chains 68. The sprocket 69 secured to the shaft 66 is driven by suitable means, such as an electrical motor and driving chain. The chains 68 are disposed in the manner described in said U.S. Pat. No. 3,447,450 whereby they accommodate a latitude of movement between the wheels toward and away from each other.

A portion of the periphery of each wheel is disposed within the casing 28 (FIG. 4) during normal operation. Suitable means, such as the replaceable wear ring 71 on the casing and the resilient ring 72 disposed in a groove in the wheel, serves to minimize wear between the interfitting members and also provides an approximate seal.

Operation of the press is as follows. When in normal operation, the wheels are being driven in the same direction by the drive chains 68, and they are yieldably urged together by the device 22. A pinch zone is established at the front of the machine, namely the left hand side as viewed in FIG. 1. The rings 63 on the inner end portion of the plow normally occupy a position within the wear ring 64 as shown in FIG. 4. Liquor expressed through the screen 46 in the pinch zone flows into the spaces between the ribbing 42, 44 and 45 and finds its way through openings in the ribs to the bottom of the wheel where it is received by suitable collecting means (not shown). The hydraulic system for applying pressure to the device 22 may make use of a pneumatic-hydraulic accumulator in the manner disclosed in U.S. Pat. No. 3,447,450, and the pressure may be adjusted to suit operating conditions, or may be controlled automatically by use of suitable sensing means. When it is desired to clear or repair the machine when not in use, one or both of the side structures are disconnected from the device 22 and swung apart for free access to the wheels and screens 43. Also the closures 48 and 56 can be removed for removing any accumulations due to extrusion of material through the clearance between the rings 63 and the wear ring 64.

What is claimed is:

1. In a continuous press for extracting liquid from liquid containing feed materials, a main machine frame, a pair of rigid side structures, means serving pivotally to carry corresponding end portions of the structures on the frame, a pair of opposed wheels disposed between the side structures, each wheel having a central annular opening and including a conical shaped screen mounted on the inner face of the same and a main annular wheels structure, means for journalling each wheel to its corresponding side structure, means for yieldably urging the side structures and wheels toward each other, the axes of the wheels during operation being out of alignment whereby when the wheels are rotated portions of the screens are brought into proximity in a pinch zone and other portions of the screens are separated to form a feed receiving space, casing means carried by the frame and surrounding the space between the screens of the wheels, the casing means having an inlet opening for receiving feed material and a discharge opening spaced from the inlet opening for discharging material, a rigid plow having one outer end portion secured to the casing between said openings, the other inner and end portion of the plow being disposed in the central region of the casing and between the central regions of the wheels, the plow serving to divert material through the discharge opening, means for journalling each wheel to its corresponding side structure, said wheel journalling means comprising an annular sleeve fixed to the main wheel structure of each wheel and extending from the outer side of the same concentric with the axis of the wheel, the corresponding side structure having an opening to accommodate the sleeve and also having bearing means surrounding the sleeve for journalling the wheels, the inner end portion of the plow being formed to have annular interfitting relationship with the central openings of the wheels, said central openings being accessible through the sleeves.

2. A continuous filter press as in claim 1 in which each wheel structure includes a drive sprocket, the drive sprocket surrounding the sleeve and fixed to the same.

3. A continuous filter press as in claim 2 in which thrust bearing means is interposed between the inner face of each side structure and the outer face of the sprocket of the corresponding wheel.

4. A continuous press as in claim 1 in which the inner end of the plow is constructed to provide projecting rings on its opposite sides, each ring being dimensioned to be accommodated within the opening of its corresponding wheel.

5. In a continuous press for extracting liquid from liquid containing feed materials, a main machine frame, a pair of rigid side structures, means serving pivotally to carry corresponding end portions of the structures on the frame, a pair of opposed wheels, each wheel including a conical shaped screen mounted on the inner face of the same and a main annular wheel structure, means for yieldably urging the side structures and wheels toward each other, the axes of the wheels during operation being out of alignment whereby when the wheels are rotated portions of the screens are brought into proximity in a pinch zone and other portions of the screens are separated to form a feed receiving space, casing means carried by the frame and surrounding the space between the screens of the wheels, the casing means having an inlet opening for receiving feed material and a discharge opening spaced from the inlet opening for discharging material, a plow having one outer end secured to the casing between the openings, the other inner end portion of the plow being disposed in the central region of the casing between the central regions of the wheels, the plow serving to divert material through the discharge opening, and means for journalling each wheel to its corresponding side structure, each wheel structure having a central annular opening, the inner end of the plow being constructed to provide annular projections on its opposite sides dimensioned to be accommodated within and to interfit said openings.

6. A continuous press as in claim 5 in which the annular projections are in the form of rings on the opposite sides of the inner end of the plow, each ring being dimensioned to be accommodated within and to interfit the opening of its corresponding wheel.

7. A continuous press as in claim 6 in which the outer end faces of the rings are coincident with planes that are at an acute angle with respect to each other.

* * * * *